US008147255B2

(12) United States Patent
Wu

(10) Patent No.: US 8,147,255 B2
(45) Date of Patent: Apr. 3, 2012

(54) ELECTRICAL CONNECTOR ASSEMBLY WTH COMPACT CONFIGURATION

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/962,670

(22) Filed: Dec. 8, 2010

(65) Prior Publication Data

US 2011/0136368 A1 Jun. 9, 2011

(30) Foreign Application Priority Data

Dec. 8, 2009 (CN) ..... 200920316731.1

(51) Int. Cl.
*H01R 13/62* (2006.01)

(52) U.S. Cl. ..... 439/76.1; 439/358

(58) Field of Classification Search ..... 439/76.1, 439/352–358, 606, 607.41, 607.46, 607.49, 439/607.56

See application file for complete search history.

(56) References Cited

U.S. PATENT DOCUMENTS

| | | | | |
|---|---|---|---|---|
| 6,860,749 | B1 * | 3/2005 | Wu | 439/352 |
| 6,890,205 | B1 * | 5/2005 | Wu | 439/358 |
| 6,896,540 | B1 * | 5/2005 | Wu | 439/417 |
| 7,232,329 | B1 * | 6/2007 | Wu | 439/358 |
| 7,303,438 | B2 | 12/2007 | Dawiedczyk et al. | |
| 7,581,978 | B1 | 9/2009 | Briant | |
| 7,909,661 | B2 * | 3/2011 | Wu | 439/701 |

* cited by examiner

*Primary Examiner* — Thanh Tam Le

(74) *Attorney, Agent, or Firm* — Wei Te Chung; Andrew C. Cheng; Ming Chieh Chang

(57) ABSTRACT

An electrical connector assembly (100), comprises an insulative housing (1) having a receiving space (14) therein communicated with an exterior along a longitudinal direction, a partition (15) formed in the receiving space and dividing the receiving space into a front receiving room (141) and a rear receiving room (142). Two PCB modules (2, 3) are arranged in a stacked manner and received into the receiving space. Each PCB module defines a mating section (210, 310) passing through the partition and received into the front receiving room. And two mating sections of the two PCB modules are spaced apart with each other along a vertical direction. And a latch (5) is assembled to the insulative housing.

12 Claims, 9 Drawing Sheets

ELECTRICAL CONNECTOR ASSEMBLY WTH COMPACT CONFIGURATION

FIELD OF THE INVENTION

The present invention generally relates to connectors suitable for transmitting data, more specifically to input/output (I/O) connectors with high-density configuration and high data transmitting rate.

DESCRIPTION OF PRIOR ART

One aspect, recently, communication device (such as sever, router, etc.) has a developing trend to miniaturization. Thus, an internal room of the communication device will be smaller and smaller. Generally, traditional I/O connector has a lager width. So, traditional I/O connector disposed on a PCB card of the communication device will occupy more room. And, an number of the I/O connectors disposed on the PCB card will be less. So, I/O connectors disposed in the communication device are required to make more compact.

Additionally, Mini SAS connectors are widely used in the server. And, a physical channel rate of the Mini SAS connector is reach to 3 Gbps. However, the above said data transmitting rate will not meet more and more higher data transmitting rate requirements of the server.

As discussed above, an improved electrical connector overcoming the shortages of existing technology is needed.

SUMMARY OF THE INVENTION

Accordingly, an object of the present invention is to provide an electrical connector assembly with high-density configuration and high data transmitting rate.

In order to achieve the above-mentioned objects, an electrical connector assembly, comprises an insulative housing having a receiving space therein communicated with an exterior along a longitudinal direction, a partition formed in the receiving space and dividing the receiving space into a front receiving room and a rear receiving room; two PCB modules arranged in a stacked manner and received into the receiving room, each PCB module defining a mating section at a front end thereof and passing through the partition and received into the front receiving room, and two mating sections of the two PCB modules spaced apart with each other along a vertical direction; and a latch assembled to the insulative housing.

Other objects, features and advantages of the invention will be apparent from the following detailed description taken in connection with the accompanying drawings.

DETAILED DESCRIPTION OF PREFERRED EMBODIMENTS

Figure 1:
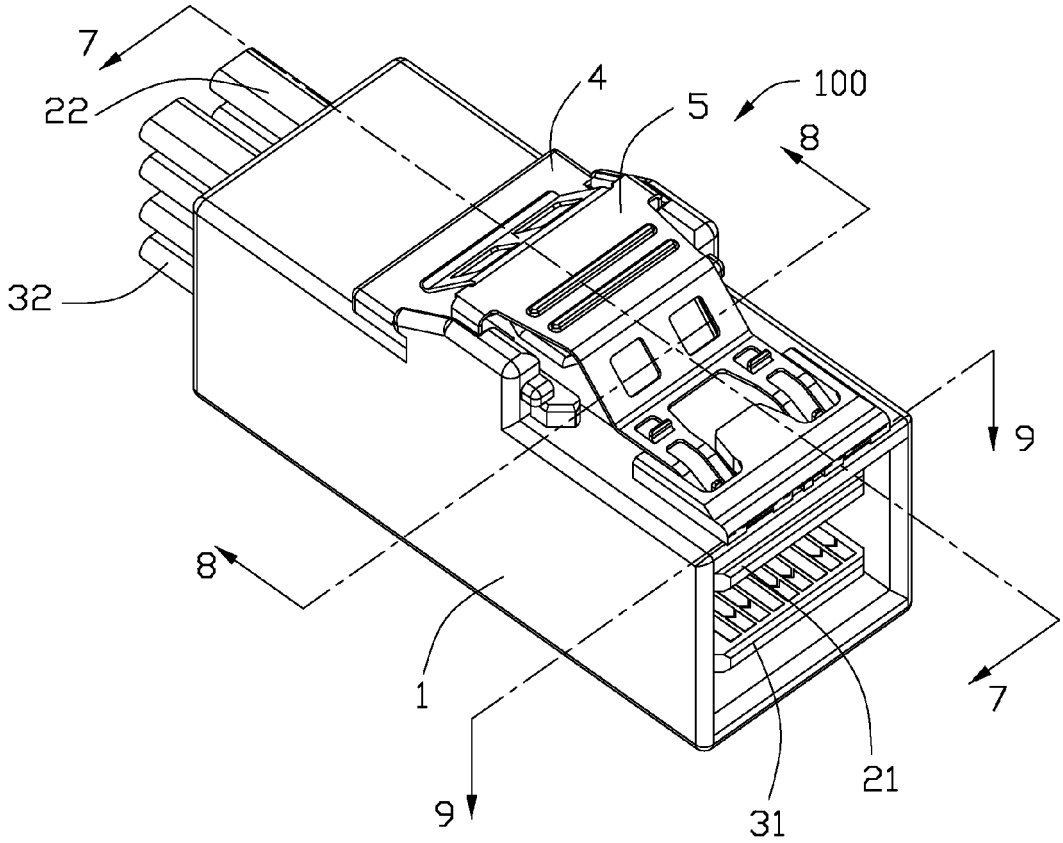
FIG. 1 is a perspective view of an electrical connector assembly in accordance with the present invention.

Reference will now be made to the drawing figures to describe the present invention in detail.

Figure 2:
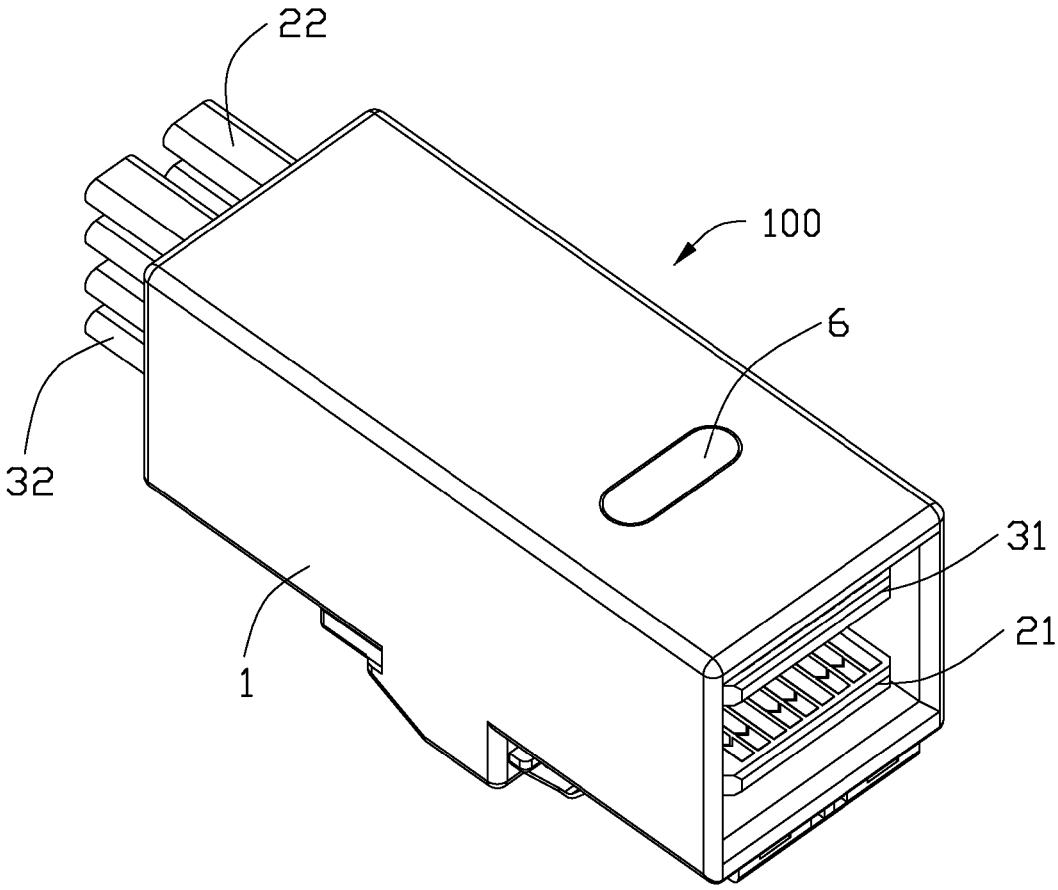
FIG. 2 is similar to FIG. 1, but viewed from another aspect.

FIGS. 1 to 2 illustrate perspective views of an electrical connector assembly 100 made in accordance with the present invention. Referring to FIGS. 3 to 4 and 7 to 8, the electrical connector assembly 100 comprises a box-shape insulative housing 1, a first and second PCB modules 2, 3 disposed in the insulative housing 1, a platform 4 disposed on a top surface of the insulative housing 1 and engaged with the insulative housing 1 and a latch 5 assembled to the top surface of the insulative housing 1 and having a portion located upon the platform 4. The electrical connector assembly 100 further has a retainer 6 assembled to the insulative housing 1 and interfered with the first and second PCB modules 2, 3 to make the insulative housing 1 and the first and second PCB modules 2, 3 positioned with each other.

Referring to FIGS. 3 to 7, the insulative housing 1 defines a top wall 11, a bottom wall 12 opposite to the top wall 11 and a pair of side walls 13 respectively connected with the two sides of the top and bottom walls 11, 12. A receiving space 14 is enclosed by the top wall 11, the bottom wall 12 and a pair of side walls 13 and communicated with an exterior along a longitudinal direction. The insulative housing 1 further defines a generally M-shaped interferential portion 110 and a pair of positioning portions 111 formed on a top surface of the top wall 11. The pair of positioning portions 111 are disposed at two sides of the top surface of the top wall 11 and located in back of the interferential portion 110. Each positioning portion 111 defines a vertical base section 112 extending upwardly from the top surface of the top wall 11 and a horizontal limiting section 113 extending inwardly from an inner surface of the base section 112 and spaced apart with the top surface of the top wall 11. So, a limiting space 114 is formed between the top wall 11 of the insulative housing 1 and the limiting section 113. The insulative housing 1 further defines a partition 15 formed in the receiving space 14 and dividing the receiving space 14 into a front receiving room 141 and a rear receiving room 142 in a front to rear direction. The partition 15 defines two paralleled slots 151 extending from a front surface to a rear surface thereof and communicating the front receiving room 141 to the rear receiving room 142. The partition 15 further defines two grooves 143 recessed on the rear surface thereof and communicated with the rear receiving room 142. In addition, the insulative housing 1 defines a recess 121 formed on a bottom surface thereof. The partition 15 defines a pair of vertical receiving holes 152 arranged along a transverse direction and extending downwardly and communicated with the recess 121. Each receiving hole 152 is crossed with two paralleled slots 151.

Figure 3:
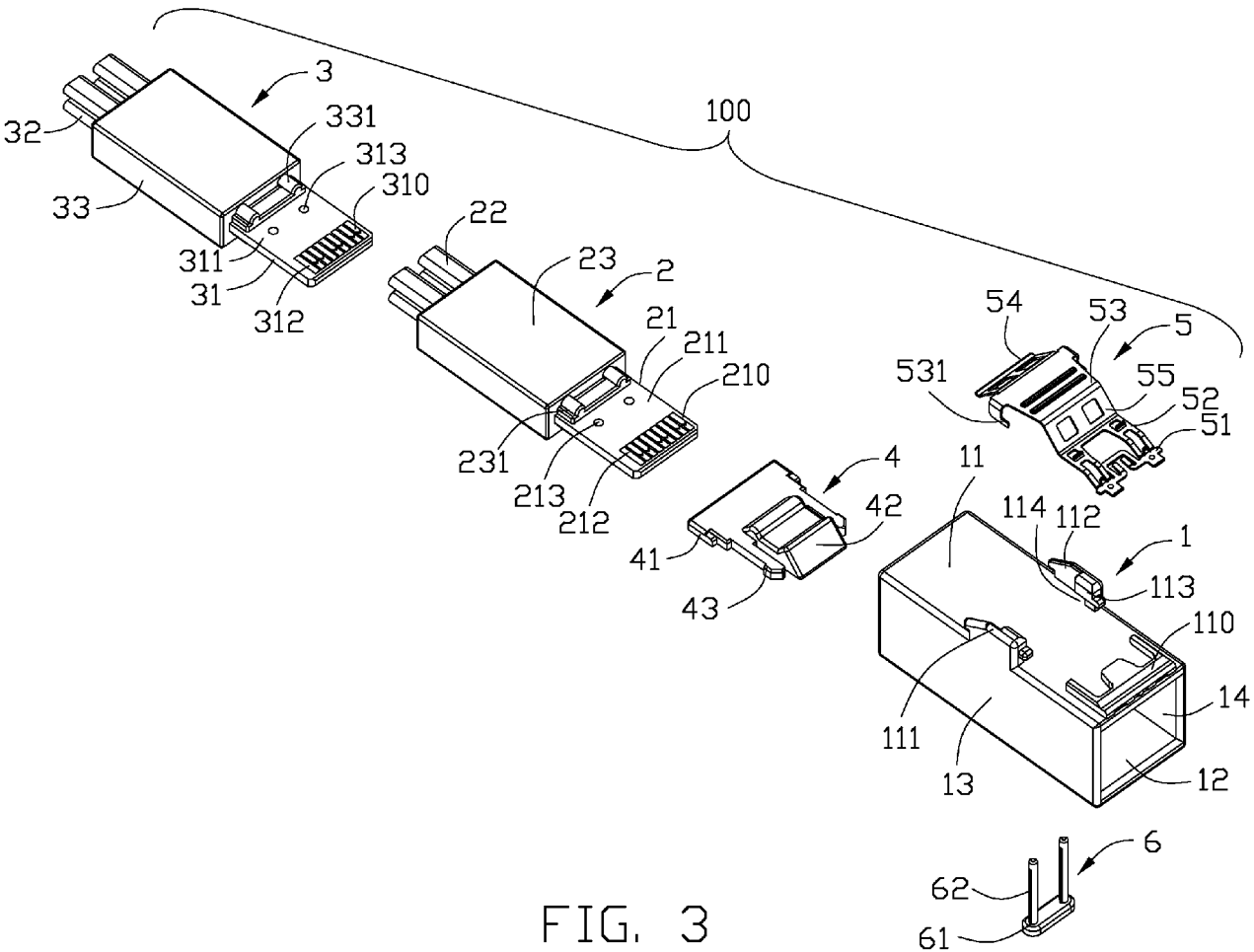
FIG. 3 is an exploded, perspective view of the electrical connector assembly of FIG. 1.
Figure 4:
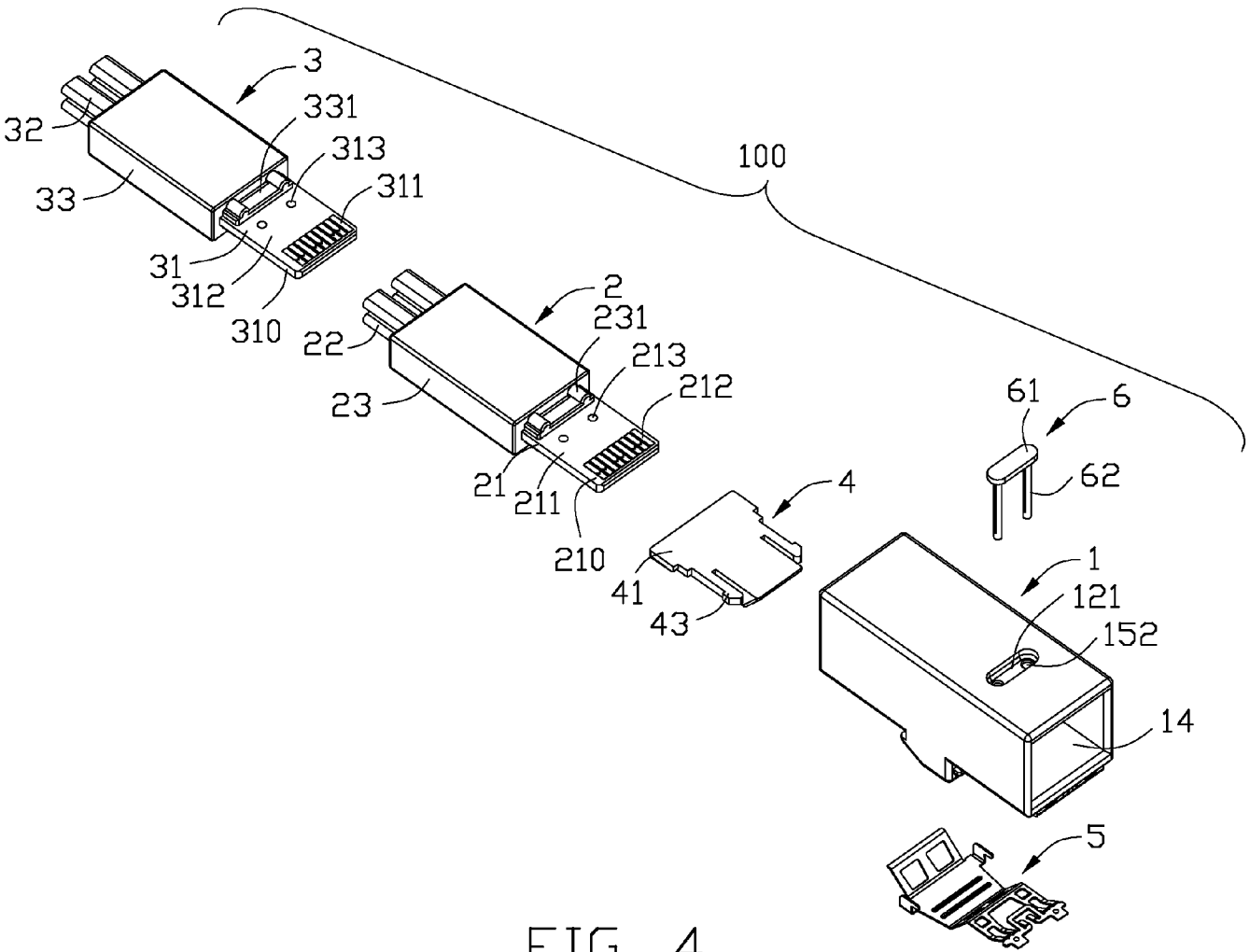
FIG. 4 is an exploded, perspective view of the electrical connector assembly of FIG. 2.
Figure 5:
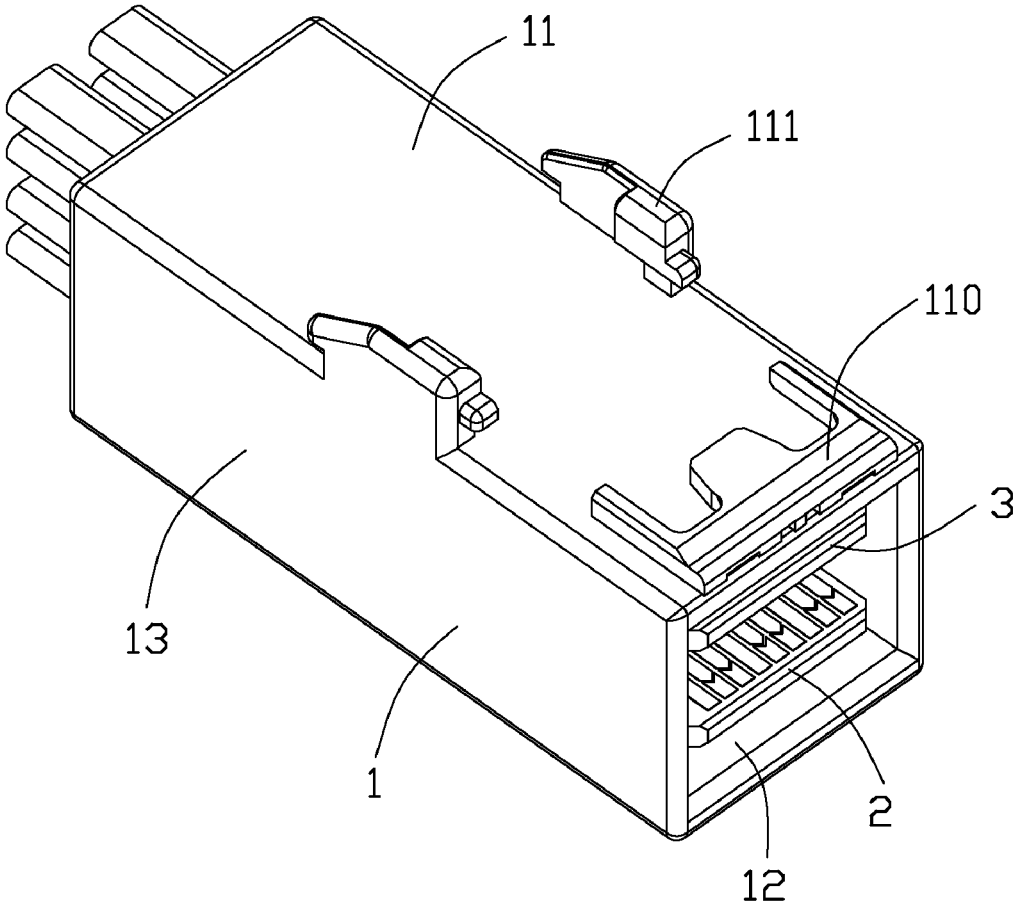
FIG. 5 is a partially assembled view of the electrical connector assembly of FIG. 1.
Figure 6:
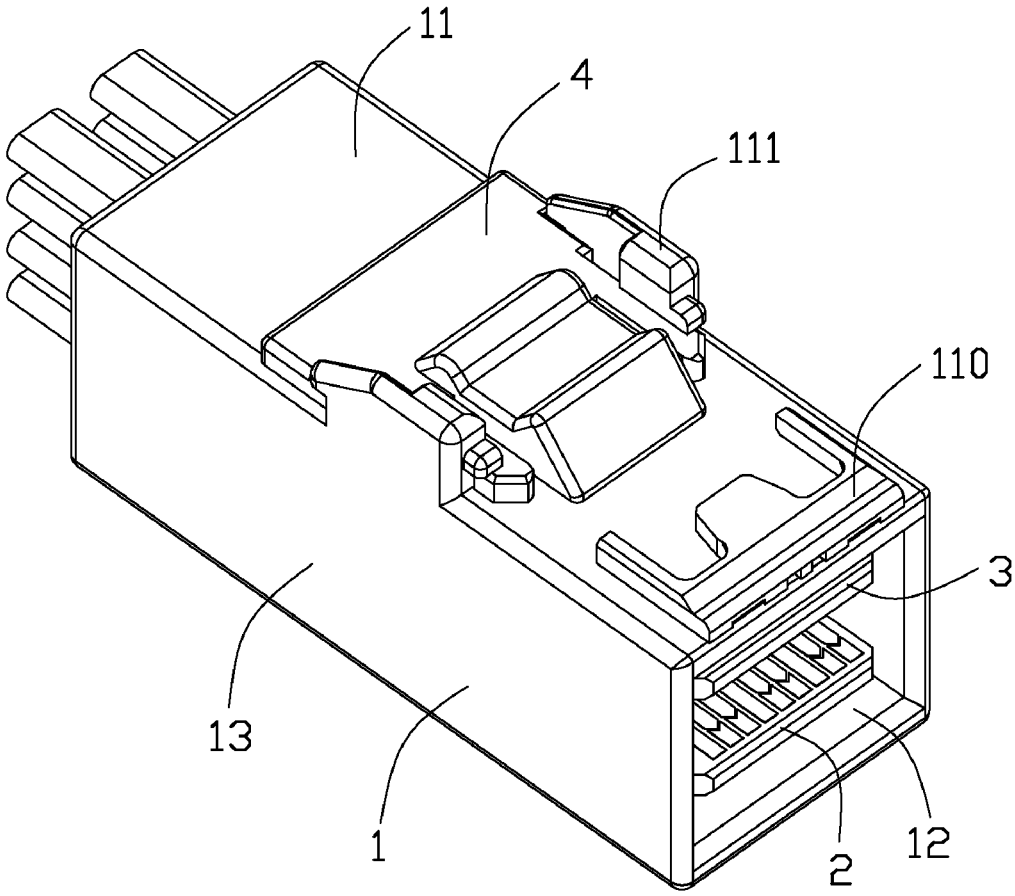
FIG. 6 is an another partially assembled view of the electrical connector assembly of FIG. 5.
Figure 7:
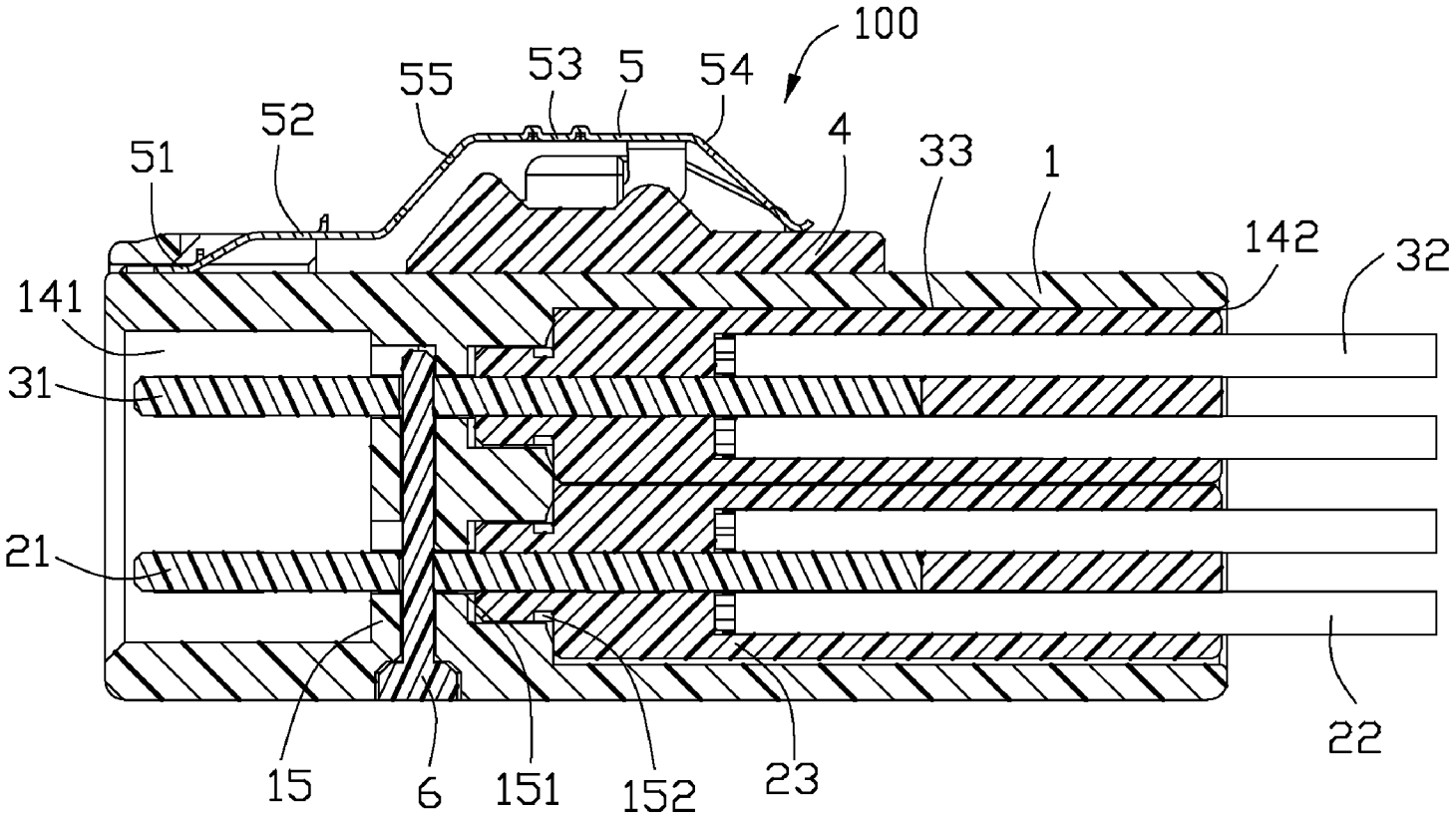
FIG. 7 is a cross section view of the electrical connector assembly of FIG. 1 taken along line 7-7.
Figure 8:
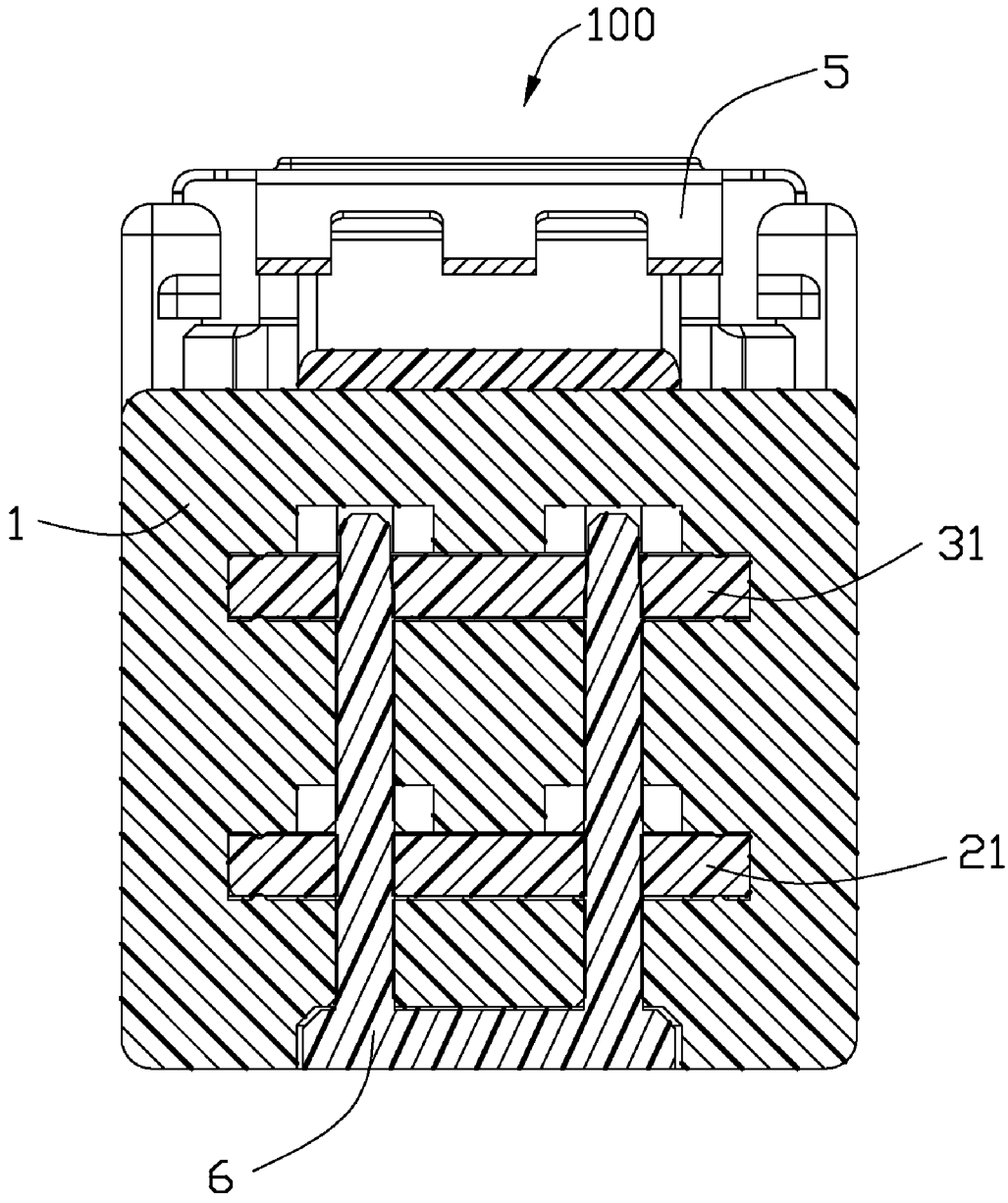
FIG. 8 is a cross section view of the electrical connector assembly of FIG. 1 taken along line 8-8.
Figure 9:
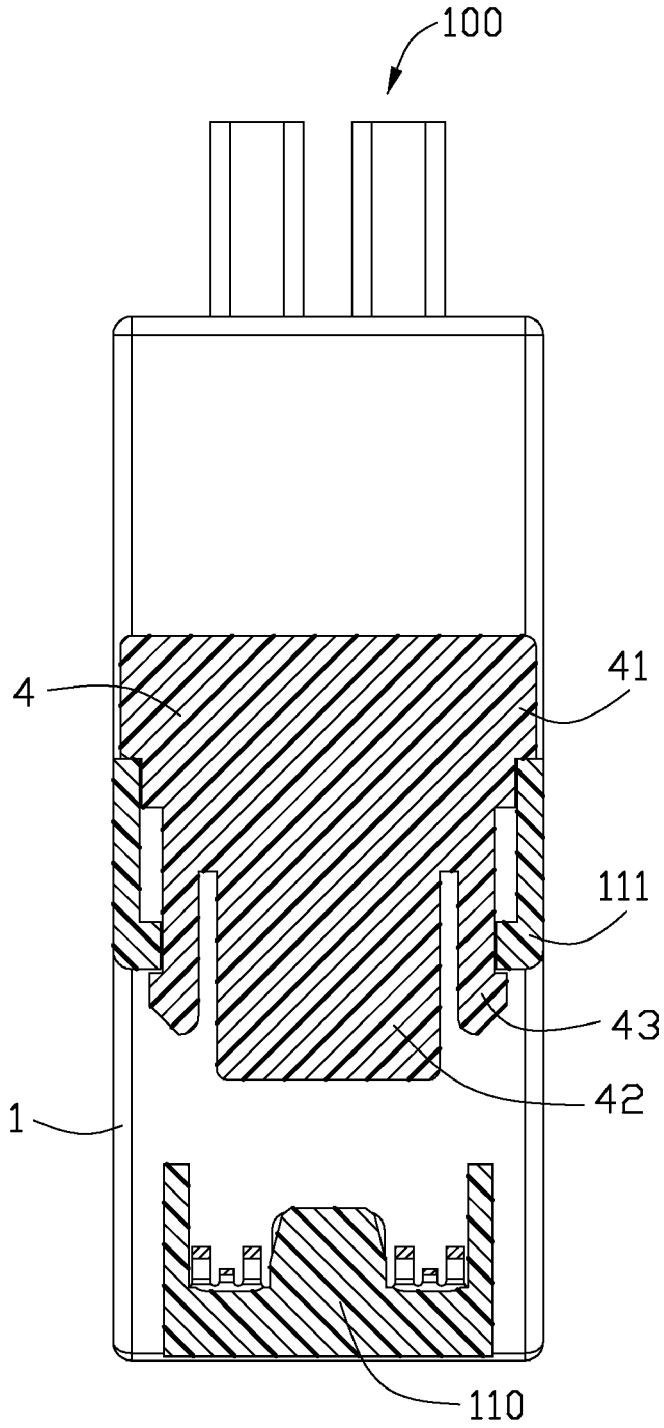
FIG. 9 is a cross section view of the electrical connector assembly of FIG. 1 taken along line 9-9.

Referring to FIGS. 3 to 4 and in conjunction with FIGS. 7 to 8, the first PCB module 2 comprises a first printed circuit board 21 and four first cables 22 electrically connected with the first printed circuit board 21 and a first insulator 23 overmolding around a front end of the first cables 22 and a rear end of the first printed circuit board 21 for protecting a connection between the first printed circuit board 21 and four first cables 22. The first printed circuit board 21 defines a mating section 210, a connecting section 211 disposed in back of the mating section 210 and a soldering section (not figured) electrically connected with the first cables 22. The mating section 210 defines a plurality of conductive pads 212 formed on two opposite upper and lower surfaces and arranged along a widthwise direction. The connecting section 211 defines two first positioning holes 213 spaced apart with each other and arranged along a widthwise direction. The first insulator 23 defines a front guiding section 231 disposed at two sides of the first printed circuit board 21 and received into a groove 143 of the insulative housing 1.

The second PCB module 3 has a similar structure with the first PCB module 2. The second PCB module 3 comprises a second printed circuit board 31 and four second cables 32 electrically connected with the second printed circuit board 31 and a second insulator 33 over-molding around a front end of the second cables 32 and a rear end of the second printed circuit board 31 for protecting a connection between the second printed circuit board 31 and four second cables 32. The second printed circuit board 31 defines a mating section 310, a connecting section 311 disposed in back of the mating section 310 and a soldering section (not figured) electrically connected with the second cables 32. The mating section 310 defines a plurality of conductive pads 312 formed on two opposite upper and lower surfaces and arranged along a widthwise direction. The connecting section 311 defines two second positioning holes 313 spaced apart with each other and arranged along a widthwise direction. The first insulator 33 defines a front guiding section 331 disposed at two sides of the first printed circuit board 31 and received into another groove 143 of the insulative housing 1.

Referring to FIGS. 3 to 4 and 7 to 9, a flat platform 4 is made of insulative material. The platform 4 is attached to the top surface of the top wall 11 of the insulative housing 1 and latched to the pair of positioning portions 111. The platform 4 defines a main section 41, an extruding section 42 extending forwardly from a front end of the main section 41 and a pair of elastic latching sections 43 disposed at two sides of the extending section 42. The main section 41 has two step-shape lateral surface.

Referring to FIGS. 3 to 4 and in conjunction with the FIG. 7, the latch 5 is stamped and formed from a metallic plate and comprises a retaining portion 51, a pair of locking portions 52 extending upwardly and rearwardly from the retaining portion 51, a N-shape pressing portion 53 formed at a rear position of the pair of locking portions 52, and an inclined supporting portion 54 slantwise extending from the pressing portion 53. The latch 5 further forms a generally intermediate portion 55 connecting the pressing portion 53 with the locking portions 52. The pressing portion 53 defines a pair of protruding pieces 531 respectively formed on two sides thereof.

Referring to FIGS. 2 to 3 and in conjunction with FIGS. 7 to 8, the retainer 6 is made of insulative material and has a base portion 61 and a pair of positioning posts 62 extending from a top surface thereof for a distance.

Referring to FIGS. 1 to 9, the assembling process of the electrical connector assembly 1 made in according to the present invention starts from assembling the first and second PCB modules 2, 3 into the receiving space 14 of the insulative housing 2 along a front to rear direction. The first and second PCB modules 2, 3 are arranged in a stacked manner when the first and second PCB modules 2, 3 are fully received into the receiving space 14. And, the mating sections 210, 310 of the first and second printed circuit boards 21, 31 are passed through two slots 151 of the partition 15 and received into the front receiving room 141. The first and second insulators 23, 33 are filled in the rear receiving room 142. The front guiding section 231, 331 of the first and second printed circuit boards 21, 31 are received into two grooves of the partition 15 of the insulative housing 1. The first and second positioning holes 213, 313 of the first and second printed circuit boards 21, 31 are in alignment with two receiving holes 152 along a vertical direction.

After the first and second PCB modules 2, 3 are received into the receiving space 14 of the insulative housing 1, then assembling the retainer 6 to the bottom wall 12 of insulative housing 1. The pair of positioning posts 62 are received into the receiving holes 152 of the partition 15 and passed through the first and second positioning holes 213, 313 of the first and second printed circuit board 21, 31. Thus, the retainer 6 is interfered with the first and second PCB modules 2, 3. The base portion 61 of the retainer 6 is received into the recess 121.

After the retainer 6 is assembled to the insulative housing 1, then assembling the platform 4 to the top surface of the top wall 11 of the insulative housing 1. The pair of latching portions 43 are locked with the pair of positioning portions 111. The extruding section 42 is disposed between the pair of positioning portions 111. The main section 41 is disposed in back of the pair of positioning portions 111.

Finally, assembling a latch 5 to the top wall 11 of the insulative housing 1. A forward pressing force is exerted on the latch 5. The retaining portion 51 is engaged with the interferential portion to make the latch 5 positioned on the top wall 11. The pressing portion 53, the inclined supporting portion 54, the inclined intermediate portion 55 and the locking portions 52 are cantilevered relative to the retaining portion 51. The pair of protruding pieces 531 of the pressing portion 53 are interferential with the pair of positioning portions 111 to limit the excessive movement of the pressing portion 53 in a down to up direction.

After the above assembling steps, the entire process of assembling of the electrical connector assembly 1 is finished. The electrical connector assembly 1 has a new mating surface to meet higher and higher data transmitting rate. In addition, the electrical connector assembly 1 has a narrow and lower profile. Thus, the complementary connector (not shown) for mating with the electrical connector assembly 1 will also occupy little space to meet the miniaturization of the communication device.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly, comprising:

an insulative housing having a receiving space therein communicated with an exterior along a longitudinal direction, a partition formed in the receiving space and dividing the receiving space into a front receiving room and a rear receiving room;

two PCB (printed circuit board) modules arranged in roughly a stacked manner and received into the receiving room, each PCB module defining a mating section at a front end thereof and passing through the partition and received into the front receiving room, and two mating sections of the two PCB modules spaced apart with each other along a vertical direction; and a latch assembled to the insulative housing;

wherein the insulative housing defines a top wall, a bottom wall and a pair of side walls connected with the top and bottom walls, the receiving space enclosed by the top wall, the bottom wall and the pair of side walls;

wherein the insulative housing defines an interferential portion formed on a top surface of the top wall and engaged with a front end of the latch;

wherein the insulative housing defines a pair of positioning portions disposed in back of the interferential portion, the latch defines a pair of protruding pieces at two sides thereof respectively limited by the pair of positioning portions in a down to up direction;

wherein the electrical connector assembly further defines a platform assembled to the top surface of the top wall and engaged with the pair of positioning portions, and the platform is located below the latch; and wherein the platform defines a main section, an extruding section extending forwardly from the main section and disposed below the latch and a pair of elastic latching sections disposed at two sides of the extruding section and engaged with the pair of the positioning portions.

2. The electrical connector assembly as recited in claim 1, wherein the electrical connector assembly further defines a retainer assembled to the insulative housing and interfered with the first and second PCB modules to make the insulative housing and the first and second PCB modules positioned with each other.

3. The electrical connector assembly as recited in claim 1, wherein each PCB module has a printed circuit board, a plurality of cables electrically connected to the printed circuit board and an insulator over-molding around a rear end of the printed circuit board and a front end of the plurality of cables, the mating section is formed on a front end of the printed circuit board.

4. The electrical connector assembly as recited in claim 3, wherein the two insulators of the two PCB modules are filled into the rear receiving room, the plurality of cables of the two PCB modules are extending rearwardly and out of the insulative housing.

5. The electrical connector assembly as claimed in claim 1, wherein each PCB module includes a PCB enclosed by an insulator around a rear portion of the PCB under condition that only a front portion of the PCB extends through the partition into the front receiving room so as to have the two PCBs of said two PCB modules spaced from each other in a parallel relation while having the two insulators of said two PCB modules stacked with each other in the rear receiving room.

6. The electrical connector assembly as claimed in claim 5, further including a retainer secured to the housing and extending in the partition and through both said two PCBs.

7. The electrical connector assembly as claimed in claim 1, wherein the two PCB modules have corresponding rear portions directly touching each other.

8. An electrical connector assembly, comprising:

a housing defining a front receiving room and a rear receiving room spaced apart by a partition disposed in the housing;

two paralleled printed circuit boards disposed in the housing and having two mating sections passing through the partition and received into the front receiving room;

a plurality of cables electrically connected to rear end of the two printed circuit boards and extending out of the housing; and a latch formed to an exterior surface of the housing;

wherein two insulators are respectively formed on a connection between the printed circuit boards and the cables and filled into the rear receiving room;

wherein the housing defines an interferential portion and a pair of positioning portions formed on a top surface of the housing, the pair of positioning portions are located in back of the interferential portion;

wherein the electrical connector assembly further comprises a platform assembled to said exterior surface of the housing and engaged with the pair of positioning portions, and the platform is disposed below the latch; and wherein the platform defines a main section, an extruding section extending forwardly from the main section and disposed below the latch and a pair of elastic latching sections disposed at two sides of the extruding section and engaged with the pair of the positioning portions.

9. The electrical connector assembly as recited in claim 8, wherein the latch defines a retaining portion disposed in a front end thereof and engaged with the interferential portion of the housing and a pair of protruding pieces respectively limited by the pair of positioning portions in a down to up direction.

10. The electrical connector assembly as recited in claim 8, wherein the electrical connector assembly further comprises a retainer assembled to the housing and received into the partition in a down to up direction, and two positioning posts of the retainer pass through two printed circuited boards.

11. The electrical connector assembly as claimed in claim 8, further including a platform assembled upon said exterior surface and below the latch, wherein said platform is configured to comply with an contour of the latch.

12. The electrical connector assembly as claimed in claim 11, wherein said platform and said housing is configured to allow said platform to be assembled to the housing in a horizontal direction defined by a mating axis of said connector assembly.

* * * * *